United States Patent [19]

Bird et al.

[11] 4,376,565

[45] Mar. 15, 1983

[54] ELECTRICAL CONNECTOR KEYING MEANS

[75] Inventors: Philip S. Bird, Lancaster; Christopher J. O'Neill, Harrisburg, both of Pa.

[73] Assignee: AMP Incorporated, Harrisburg, Pa.

[21] Appl. No.: 234,299

[22] Filed: Feb. 17, 1981

[51] Int. Cl.[3] ..... H01R 13/645

[52] U.S. Cl. ..... 339/186 M

[58] Field of Search ..... 339/184, 186

[56] References Cited

U.S. PATENT DOCUMENTS

| | | | |
|---|---|---|---|
| 3,112,974 | 12/1963 | Curtis et al. | 339/49 |
| 3,614,714 | 10/1971 | Silverstein | 339/186 M |
| 3,714,617 | 1/1973 | Bright et al. | 339/186 M |

FOREIGN PATENT DOCUMENTS

| | | | |
|---|---|---|---|
| 2021547 | 11/1971 | Fed. Rep. of Germany | 339/186 M |
| 586962 | 4/1977 | Switzerland | 339/186 R |
| 1568189 | 5/1980 | United Kingdom | 339/186 M |

*Primary Examiner*—Neil Abrams

*Attorney, Agent, or Firm*—Frederick W. Raring; Adrian J. LaRue

[57] ABSTRACT

Electrical connector of the type comprising a plug and a receptacle has changeable keying means. Keying means comprises axially extending latent slots in the hood of the receptacle and grooves on the surface of the plug which receive a key. Slots can be obtained from the latent slots by removing a thin wall section in the hood. A key is then placed in the corresponding groove in the plug so that the key is received in the slot when the parts are mated. Several latent slots are provided in the receptacle hood to permit a plurality of keying arrangements.

3 Claims, 5 Drawing Figures

ELECTRICAL CONNECTOR KEYING MEANS

FIELD OF THE INVENTION

This invention relates to electrical connectors of the type comprising a receptacle and a plug, and particularly to improved keying systems for such connectors.

BACKGROUND OF THE INVENTION

It is common practice to provide on plug and receptacle type electrical connectors keying means which permits a keyed pair of connector parts to be mated with each other and which prevents the mating of either of the keyed parts with another connector part not having the same keying code. Keying systems are desirable when it is necessary to mount several identical connector assemblies close to each other for the reason that, in the absence of suitable keying means, a technician might mismate the connector parts with each other and thereby render the circuits inoperable or such mismating might cause serious damage to the circuits.

There are many keying systems in use and, while they all perform the keying functions adequately, most are subject to some objections. For example, a keying system for a connector assembly can be produced on the connector assembly at the time of manufacture by forming complementary keys and keyways on the two parts of the connector assembly. This is an effective keying system since it cannot be changed by a technician; however, it is necessary to change the manufacturing process from one connector assembly to another to produce the different keying systems. This type of keying system is relatively expensive in that it significantly increases the manufacturing cost of the connector for the reason that the connectors produced on a long production run are not identical to each other but differ from each other in respect to the locations of the keys and keyways.

It is also common practice to use a plug in one of the terminal-receiving cavities in one of the connector parts. The complementary connector part is keyed to the connector part having the plugged cavity if no terminal is mounted in the corresponding cavity of the complementary connector part. This keying system is highly effective but it results in the loss of one of the terminals in each connector part and thereby reduces the capacity of the connector assembly to carry electrical circuits.

The present invention is directed to the achievement of a keying system which does not result in the loss of any of the terminals in the connector, which does not require changing the manufacturing steps from one connector part to an identical connector part, and which permits the technician to establish the keying system at the time of installation of the connector on the equipment on which it is used. The invention is further directed to the achievement of a keying means on connectors which can be changed, if required, without damage to either of the connector parts.

An electrical connector assembly in accordance with the invention comprises a plug part and a receptacle part, the receptacle part having a hood portion which surrounds, and extends beyond, the mating face of the receptacle part. When the plug is coupled to the receptacle part, forward portions of the plug housing are received within the hood of the receptacle. The keying means comprises a key which can be assembled to the plug part by merely sliding the key into one of several grooves provided on the surface of the plug part. The hood of the receptacle has a plurality of latent slots therein in the form of thin-walled elements which can be removed with any available sharp tool. The keyway is thus produced by simply cutting out the appropriate thin-walled element of the receptacle hood and the keyway then will receive the key which has been mounted on the plug. If it is desired to change the keying arrangement for a connector assembly, a slot in the receptacle hood can be closed by inserting a key into the slot in the hood.

DETAILED DESCRIPTION OF THE PREFERRED EMBODIMENT

Figure 1:
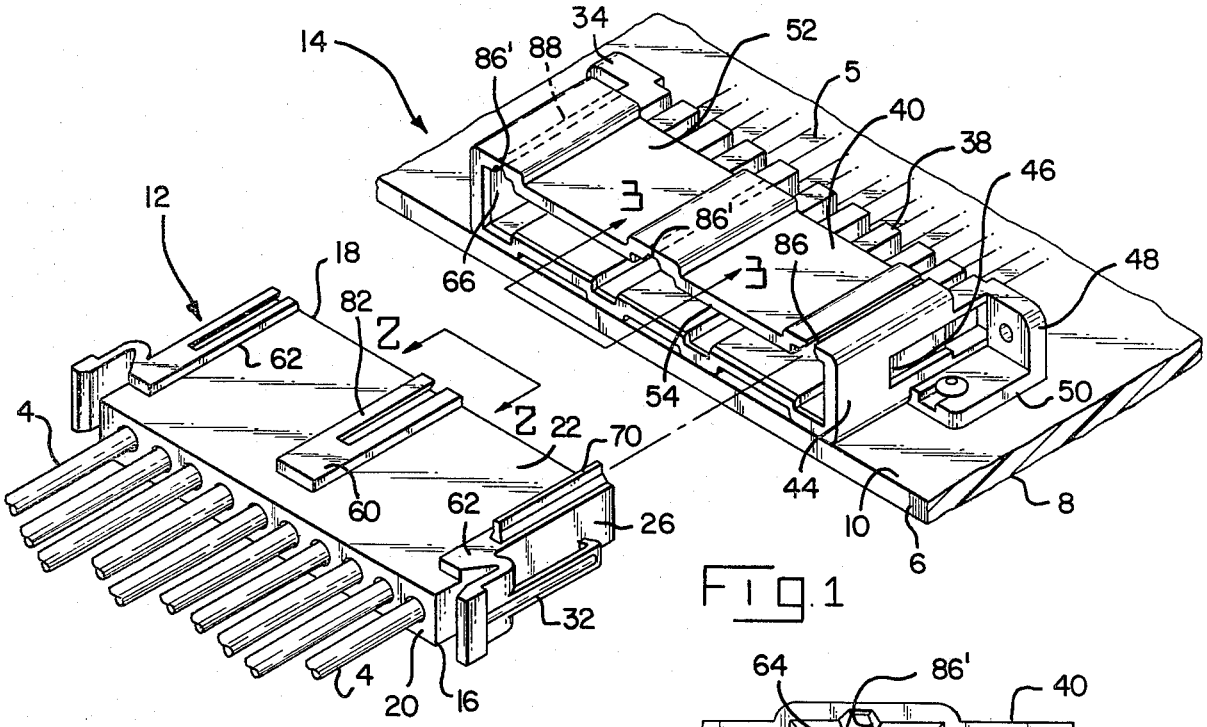
FIG. 1 is a perspective view of a connector assembly in accordance with the invention showing the plug part in alignment with the receptacle part of the connector assembly.

A connector assembly 2 in accordance with the invention serves to connect individual wires 4 which extend to a connector plug 12 to conductors 5 on the underside 6 of a circuit board 8. The connector assembly comprises the plug 12 and a receptacle 14 which is mounted on the upper surface 10 of the circuit board 8 adjacent to an edge thereof.

The plug 12 comprises a housing 16 having a rectangular cross section and having a mating face 18 and a wire entry face 20. Upper and lower sidewalls 22, 24 and endwalls 26 extend between these faces. A plurality of terminal-receiving cavities 28 extend through the housing 16 and contain contact sockets 30 which are crimped onto the wires 4. The disclosed embodiment has latch arms 32 extending from the endwalls 26 for cooperation with shoulders 46 on the endwalls 44 of the receptacle part 14.

Figure 3:
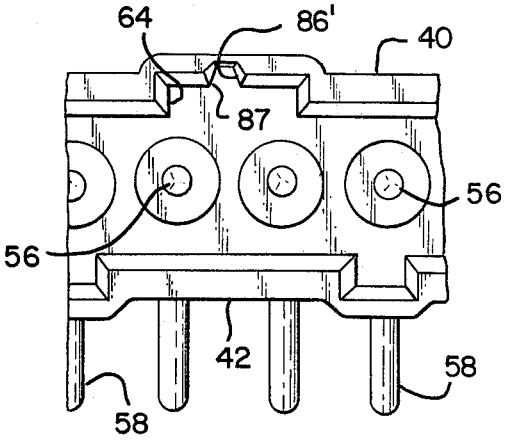
FIG. 3 is a fragmentary view looking in the direction of the arrows 3—3 of FIG. 1 showing a portion of the mating face of the receptacle part.

The receptacle 14 comprises a complementary rectangular housing 34 having a mating face 36, a rearward face 38, upper and lower sidewalls 40, 42, and endwalls 44. Contact pins 56 are provided in the cavities of the receptacle, these pins having post portions 58 which are bent downwardly as shown in FIG. 3 at the rearward end 38 of the housing. These post portions are soldered to the conductors 5 on the underside of the circuit board. The housing has flanges 48, 50 integral with its endwalls 44 for mounting the housing on a horizontal or vertical panel.

The housing hood 52 surrounds the mating face 36 and has a leading edge 54 which is spaced forwardly of the mating face and the ends of the contact pins 56. The plug and receptacle 12, 14 are polarized by the provision of ribs 60, 62 on the upper sidewall 22 of the forward portion of the plug housing and complementary recesses 64, 66 in the hood 52. Similar recesses as shown at 70, and similar ribs may be provided on the lower flange of the hood and the lower sidewall 24 of the plug. These ribs and recesses prevent mating of the connector parts with each other if they are inverted from the portions shown in FIG. 1, and they provide a visual indicator of the proper orientation of the parts for mating. However, these polarized ribs and recesses are not capable of preventing mismating, that is the mating of the plug 12 with a receptacle which is identical to the receptacle 14 and which might be mounted on the circuit board 8 adjacent to the receptacle 14. The keying means described below will prevent such mismating.

Figure 4:
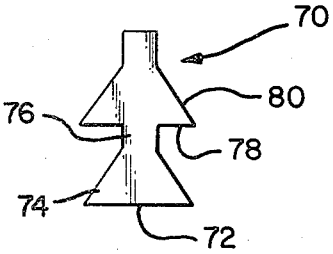
FIG. 4 is a view of the profile of a key used in the practice of the invention.

The keying means comprises a key 70, having a uniform cross section as shown in FIG. 4 consisting of a base 72, lower inwardly inclined sidewall portions 74, a relatively narrow neck 76, downwardly facing surfaces 78, and upper inwardly inclined sidewalls 80. The plug 12 is provided with a groove means 82 that extends inwardly from the mating face in each of the ribs 60, 62. As shown in FIG. 2, the grooves are of trapezoidal-shaped cross section and are dimensioned to receive the lower portions of a key of the type shown in FIG. 4. A key is shown in the groove in the rib 62 in the right in FIG. 1.

A plurality of latent slots 86' are provided in the hood portion 52 of the receptacle in alignment with the grooves 82 in the plug. Each latent slot 86' has converging sides 87, see FIG. 3, which extend to a thin-walled element 88 of the hood. These thin-walled elements can be selectively removed to provide an actual slot 86 as shown on the right in FIG. 1.

Figure 2:
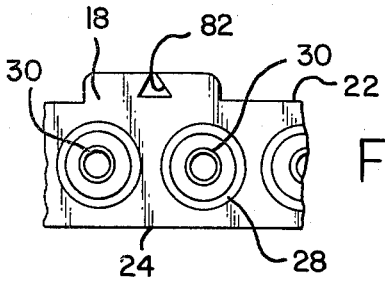
FIG. 2 is a fragmentary view looking in the direction of the arrows 2—2 of FIG. 1 and showing a portion of the mating face of the plug part.

It will be apparent that the plug 12 is keyed to the receptacle 14 in FIG. 1 by virtue of the fact that the plug has a key 70 assembled to the rib 62 on the right-hand end of the housing and the wall material has been removed from the latent slot on the right thereby to produce the actual open slot 86. When the plug 12 is mated with the receptacle 4, the key 70 shown will enter the actual slot 86. If an attempt is made to mate the plug 12 with an adjacent receptacle which does not have the thin-walled element removed on its right-hand end, it will immediately be apparent that the plug 12 is not intended for mating with the adjacent connector and it will, in fact, prove impossible to couple the two parts.

It will be apparent that a wide variety of keying codes can be achieved with the three latent slots 86' and the three grooves 82 in the plug member. Thus the advantages of an extremely versatile keying system are achieved even though the connectors as manufactured are all identical.

Figure 5:
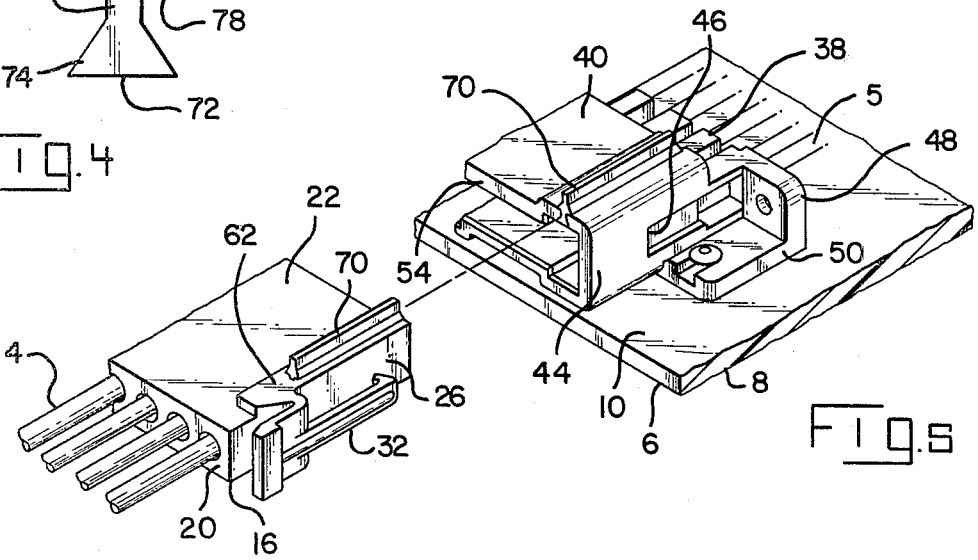
FIG. 5 is a fragmentary view similar to FIG. 1 illustrating the manner in which changes to the keying arrangement of a connector assembly can be made.

FIG. 5 illustrates the fact that corrections or changes can be made to the keying system if desired. For example, if the technician should by mistake remove the thin-walled section 88 from a receptacle, he can, after he discovers his error, simply slide a key 70 into the slot which he wishes to block. It then becomes impossible to mate the plug shown in FIG. 5 with the receptacle shown. If desired, the receptacles can all be manufactured with open slots 86 and keys be inserted into those slots which are required for a keying arrangement in a given set of circumstances. However, the thin-walled sections improve the appearance of the connector receptacle, provide added protection for the pins which project beyond the mating face of the receptacle, and these thin-walled sections are easily removed with a penknife or other blade.

It will be apparent that the advantages described in the foregoing paragraph are achieved by virtue of the fact that the grooves 82 and the actual opening slots 86, when formed, have the same cross section which is the cross section of the lower or first portion of the key 70. The key has a rib on its upper portion which is dimensioned to be freely received in an actual slot 86.

While the invention has been illustrated in conjunction with a rectangular electrical connector, it will be apparent that the principles of the invention can also be used with cylindrical electrical connectors.

What is claimed is:

1. An electrical connector assembly having improved keying means, said connector assembly comprising a plug part and a receptacle part, each of said parts comprising a housing having at least one electrical contact terminal therein, said housings each having a mating face, said mating faces being opposed to each other when said parts are coupled, said receptacle part having a hood which surrounds, and extends forwardly from, said mating face of said receptacle part, said hood having a leading edge which is spaced from said mating face of said receptacle part, said plug part having forward portions which are received in said hood when said parts are coupled, said connector assembly being characterized in that:

said hood has at least two latent slots therein extending axially from said leading edge towards said mating face of said receptacle part, each of said latent slots comprising thin-walled portions of said hood which have a wall thickness which permits easy removal thereof with resulting formation of an actual slot, at least two key-receiving groove means on said forward portions of said plug part, said groove means being in alignment with said latent slots when said parts are coupled, said groove means extending from said mating face of said plug part across said forward portions of said plug part, said groove means and an actual slot formed from one of said latent slots having cross sections which are substantially identical, at least one key which has a uniform cross section along its length, said key having a first axially extending portion which is dimensioned to be permanently placed in either one of said groove means or in an actual slot formed from one of said latent slots, said key having a second axially extending portion which is dimensioned to be freely received in an actual slot when said key is placed in one of said groove means whereby, said plug part and said receptacle part can be keyed to each other by forming an actual slot in said receptacle part and placing a key in the corresponding groove means in said plug part, and the keying can be later changed by placing a key in the actual slot in the receptacle part.

2. An electrical connector assembly as set forth in claim 1 wherein the groove means, an actual slot formed from one of said latent slots, and the first axially extending portion of the key all have a trapezoidal cross section.

3. An electrical connector assembly as set forth in claim 2 characterized in that the second axially extending portion of the key is a continuous rib.

* * * * *